US012049600B2

(12) United States Patent
Chen et al.

(10) Patent No.: US 12,049,600 B2
(45) Date of Patent: Jul. 30, 2024

(54) AQUEOUS COMPOSITION COMPRISING WATER-SOLUBLE GLYCERIN-BASED POLYALKYLENE GLYCOLS AND USE THEREOF

(71) Applicants: SASOL CHEMICALS GMBH, Hamburg (DE); SASOL (CHINA) CHEMICAL CO., LTD., Nanjing (CN)

(72) Inventors: Fangbo Chen, Nanjing (CN); Hao Fan, Nanjing (CN); Qisheng Wu, Nanjing (CN); Jun Rao, Nanjing (CN)

( * ) Notice: Subject to any disclaimer, the term of this patent is extended or adjusted under 35 U.S.C. 154(b) by 0 days.

(21) Appl. No.: 18/008,577

(22) PCT Filed: Jun. 10, 2021

(86) PCT No.: PCT/EP2021/065715
§ 371 (c)(1),
(2) Date: Dec. 6, 2022

(87) PCT Pub. No.: WO2021/250210
PCT Pub. Date: Dec. 16, 2021

(65) Prior Publication Data

US 2023/0235244 A1 Jul. 27, 2023

(30) Foreign Application Priority Data

Jun. 10, 2020 (CN) ..... 202010523890.X

(51) Int. Cl.
*C10M 173/02* (2006.01)
*C10N 20/00* (2006.01)
*C10N 40/20* (2006.01)

(52) U.S. Cl.
CPC ..... *C10M 173/02* (2013.01); *C10M 2201/02* (2013.01); *C10M 2207/125* (2013.01); *C10M 2209/1045* (2013.01); *C10M 2215/042* (2013.01); *C10N 2020/01* (2020.05); *C10N 2020/09* (2020.05); *C10N 2040/20* (2013.01)

(58) Field of Classification Search
CPC ..... C10M 173/02; C10M 2201/02; C10M 2201/087; C10M 2207/0406; C10M 2207/046; C10M 2207/122; C10M 2207/123; C10M 2207/125; C10M 2207/126; C10M 2207/127; C10M 2209/104; C10M 2209/1045; C10M 2209/105; C10M 2209/1055; C10M 2209/107; C10M 2209/1075; C10M 2209/108; C10M 2209/1085; C10M 2215/04; C10M 2215/042; C10N 2020/01; C10N 2020/02; C10N 2020/04; C10N 2020/071; C10N 2020/09; C10N 2030/02; C10N 2030/04; C10N 2030/06; C10N 2030/18; C10N 2030/52; C10N 2040/20; C10N 2040/22; C10N 2040/245; C10N 2040/246; C10N 2040/247
See application file for complete search history.

(56) References Cited

U.S. PATENT DOCUMENTS

| | | | |
|---|---|---|---|
| 3,954,639 | A | 5/1976 | Liston |
| 4,034,924 | A | 7/1977 | Carlisle |
| 5,334,322 | A | 8/1994 | Williams |
| 2007/0010406 | A1 | 1/2007 | Okamoto |
| 2016/0186085 | A1 | 6/2016 | Okamoto et al. |
| 2016/0340625 | A1 | 11/2016 | Scheibel et al. |

FOREIGN PATENT DOCUMENTS

| | | | | |
|---|---|---|---|---|
| CN | 108456587 | | 8/2018 | |
| DE | 2220338 | | 11/1973 | |
| DE | 250634 | | 10/1987 | |
| JP | 2013047319 | | 3/2013 | |
| JP | 2014105232 | | 6/2014 | |
| WO | 2014089766 | | 6/2014 | |
| WO | 2015049184 | | 4/2015 | |
| WO | WO-2015049184 | A1 * | 4/2015 | ..... C10L 1/026 |
| WO | 2015069509 | | 5/2015 | |

* cited by examiner

*Primary Examiner* — Latosha Hines
(74) *Attorney, Agent, or Firm* — Werner IP Law, P.C.

(57) ABSTRACT

The invention relates to aqueous composition comprising water-soluble glycerin-based polyalkylene glycols as synthetic base oils as well as the use of the composition and the glycerin-based polyalkylene glycols as or in metalworking fluids, wherein the glycerin was consecutively alkoxylated in the following order: first with propylene oxide, followed by ethylene oxide and finally with propylene oxide.

8 Claims, No Drawings

AQUEOUS COMPOSITION COMPRISING WATER-SOLUBLE GLYCERIN-BASED POLYALKYLENE GLYCOLS AND USE THEREOF

FIELD OF THE INVENTION

The invention relates to aqueous compositions comprising a water-soluble glycerin-based tri-block polyalkylene glycol as well as its use as a metalworking fluid, wherein the glycerin is alkoxylated first with propylene oxide, followed by ethylene oxide and finally with propylene oxide.

BACKGROUND OF THE INVENTION AND DESCRIPTION OF THE PRIOR ART

Base oils are commonly produced by refining crude oils via distillation. While the lighter oils are used for fuels, the heavier cuts are suitable as base oils. By hydroprocessing sulfur and aromatics are removed using hydrogen under high pressure in order to obtain purified base oils, which are desired when quality requirements are particularly stringent. Depending on the properties and the refining methods, base oils can be classified into five groups according to the American Petroleum Institute (API).

Synthetic base oils are assigned to groups III to IV, which are composed of oil components that have been manufactured synthetically by reaction of well-defined chemical compounds which often are petroleum-based rather than refined from existing petroleum crudes or vegetable oils. Synthetic processes enable a precise adjustment of the oil properties. Synthetic lubricants are used as a substitute for petroleum-refined oils when operating at extreme temperatures or wide temperature ranges. Aircraft jet engines, for example, require the use of synthetic base oils, whereas aircraft piston engines do not. Synthetic base oils are also used in metal processing to provide environmental and other benefits compared to conventional petroleum and animal-fat based products.

Group III: This grade comprises oils fully produced by hydrocracking of crude oils, which makes these oils purer. API defines group III as "base stocks contain greater than or equal to 90 percent saturates and less than or equal to 0.03 percent sulfur and have a viscosity index greater than or equal to 120". This group may be described as synthetic technology oils or hydrocracked synthetic oils.

Group IV: This group consists of synthetic oils made of Poly-alpha-olefins (PAO). PAO oils are stable at extreme temperatures, which makes them equally suitable for use in very cold weather (as found in northern Europe) as well as very hot weather (as in Middle East).

Group V: Any type of base oils other than mentioned in the previously defined groups is defined as a Group V base oil. Group V base oils include, among others, naphthenic oils and esters.

Esters are the most prominent synthetic oils in Group V. They are derived by reacting an optionally substituted carboxylic acid with a hydroxyl compound such as an alcohol or phenol.

Another important type of Group V oils are polyalkylene glycols (PAGs). The terms polyalkylene glycol and polyglycol are used interchangeably. Polyalkylene glycol base oils are formed by reacting water or an alcohol with one or more alkylene oxides: Propylene oxide provides water insolubility, ethylene oxide provides water solubility.

Industrial ethoxylation is primarily performed upon fatty alcohols in order to generate fatty alcohol ethoxylates (FAE's), which are a common form of a nonionic surfactant (e.g. octaethylene glycol monododecyl ether). The fatty alcohols may be obtained by the hydrogenation of fatty acids from seed oils or by hydroformylation in the Shell higher olefin process. The reaction is for example performed by blowing ethylene oxide through the alcohol at an elevated temperature such as 180° C., typically under a pressure of 1 to 2 bar and with the help of a catalyst such as potassium hydroxide (KOH).

The starting materials are usually primary alcohols as they react about 10 to 30 times faster than do secondary alcohols. Typically, 5 to 10 units of ethylene oxide are added to each alcohol molecule, however ethoxylated alcohols can be more prone to ethoxylation than the starting alcohol, making the reaction difficult to control and leading to the formation of a product with a broad distribution regarding the alkoxylation degree. Better control can be established by the use of more sophisticated catalysts, which can be used to generate narrow-range ethoxylates.

Ethoxylation can be combined with propoxylation, the reaction analogous to ethoxylation using propylene oxide as the monomer. Both reactions are normally performed in the same reactor and may be carried out simultaneously to give a random polymer, or in alternation or sequentially to obtain block copolymers. Propylene oxide is more hydrophobic than ethylene oxide and its inclusion at low levels can significantly affect the properties of the surfactant. In particular, ethoxylated fatty alcohols which have been alkoxylated with at least one propylene oxide unit are extensively marketed as defoamers.

The mixing ratio between EO and PO, plus the type of oxygen bonded in the chemical structure, crucially affects the properties of polyglycols. In gear boxes polyglycols with an EO/PO ratio of 50:50 to 60:40 are commonly used. The polyglycols of this type of composition are also generally referred to as water-soluble polyglycols.

Water-soluble polyglycols are presently about 24% of the synthetic lubricants market, whereas synthetic lubricants in total make up 4% of the whole lubricant market. Water-solubility is a feature of PAGs, which is not commonly provided by other synthetic lubricants, such as polyalphaolefins (PAO).

PAGs are used in a multitude of lubrication applications such as metalworking fluids, gear oils, chain oils, food-grade lubricants and as lubricants in HFC type hydraulics and gas compressor equipment. Metalworking fluids are used for processes with high shear rates, such as cutting, grinding and punching of metal pieces. This also includes for example the cutting of silicon wafers.

Due to the high shear rate and/or the use of water, metalworking fluids need to have a high lubricity and low foaming as well as a good cooling (quenching) and rinsing performance during the metalworking process.

In the above context quenching is the rapid cooling of a workpiece in an oil composition comprising a base oil. In gear, chain and/or hydraulic oils often no water is required and water-insoluble PAGs can therefore be used. Foaming is not a key concern.

Non-ionic surfactants based on a block ethylene oxide-block propylene oxide copolymer obtained by reacting EO and PO with water are for example sold by BASF under the names PLURONIC® and SYNATIVE®. They are available as EO-PO-EO-copolymers (PE) or PO-EO-PO-copolymers (RPE). SYNATIVE® RPE 1720 and 1740 are commonly used as defoamers and wetting agents in metal cleansing.

PAGs based on polyols such as glycerin are also known.

DE2220338 A1 discloses water-soluble lubricants, metalworking fluids and hydraulic oils, which are shown to exhibit low foaming and low formation of resins at high mechanical shear. The compositions disclosed are based on mixed polymers consisting of a starter alcohol reacted with ethylene- and propylene oxide. Preferably the polymers contain a relatively large mixed block of statistically distributed ethylene- and propylene oxide units, followed by a smaller block of pure ethylene oxide or propylene oxide units. One example is a glycerin-based polyalkylene glycol, which is firstly alkoxylated with a mixture of ethylene oxide and propylene oxide and secondly furnished with a further propylene oxide block. This results in a polyether having 60 wt.-% ethylene oxide and 30 wt.-% propylene oxide in the first block and another 10 wt.-% of propylene oxide in the subsequent block. Glycerol also called glycerine in British English or glycerin in American English is a simple polyol compound of the formula $CH_2OH—CHOH—CH_2OH$.

Many prior art documents disclose statistically distributed mixture of ethylene- and propylene oxide units added to glycerin (e.g. U.S. Pat. No. 3,954,639, DD250634 A3, U.S. Pat. No. 5,334,322, WO2015069509 A1, US20160186085 A1) for the use as base fluids in lubricant compositions.

Glycerin alkoxylated with ethylene oxide only is a well-known surfactant (US20160340625 A1), but is less soluble in oils, which are often used as one component in metalworking fluids.

Glycerin only alkoxylated with propylene oxide is known as tire lubricant (U.S. Pat. No. 4,034,924), as component in water soluble cutting oil agents (JP2014105232) or as anti-foaming agent in storage durable lubricating oils (CN108456587).

WO2015049184 discloses alkoxylated glycerin with 0 to 4 propoxy-units followed by 6 to 22 ethoxy-units endcapped with 0 to 4 propoxy-units as a methanol-soluble ignition improver for a methanol-based diesel fuel.

Commercially available glycerin-based PAGs are the products from SASOL traded under the name GLICERO-DAC® covering ethoxylated glycerin and ethoxylated/propoxylated glycerin. Other suppliers are DOW Chemicals and the VORANOL® product range, the CARPOL®-product range from Carpenter Co. or the ARCOL®-/AC-CLAIM®-product range from Covestro.

OBJECT OF THE INVENTION

The prior art provides a multitude of chemically different base oils. While testing different available base oils including PAGs, it was found that there exists a need to provide a water-soluble base oil, where the base oil shows a low tendency to foam and/or defoams quickly, has good lubricating and wettability properties, provides for efficient sedimentation or settling properties and can be easily recycled.

SUMMARY OF THE INVENTION

It was surprisingly found that polyalkylene glycols of the formula (I)

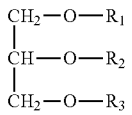

(I)

wherein independently of each other $R_1$ is $—(C_3H_6O)_{x1}—(C_2H_4O)_{y1}—(C_3H_6O)_{z1}—H$;

$R_2$ is $—(C_3H_6O)_{x2}—(C_2H_4O)_{y2}—(C_3H_6O)_{z2}—H$; and $R_3$ is $—(C_3H_6O)_{x3}—(C_2H_4O)_{y3}—(C_3H_6O)_{z3}—H$;

and x1, x2 and x3 are independently of each other a number of 0 to 6;

y1, y2 and y3 are independently of each other a number of 0 to 40; and z1, z2 and z3 are independently of each other a number of 0 to 32;

and x1+x2+x3 has an average value of from 1 to 4;

y1+y2+y3 has an average value of from 2 to 30; and z1+z2+z3 has an average value of from 1 to 25;

show at the same time a good water solubility (high cloud point) and further have in an aqueous environment good lubricity, low foam forming tendency and good wettability.

The polyalkylene glycols of the above formula (I) are part of a composition further comprising water. This is the claimed composition comprising the water-soluble glycerin-based tri-block polyalkylene glycol according to above formula (I) and water. Further their use as a base oil in a metalworking fluid is claimed.

In preferred embodiments, independent of each other, the y and z values individually or collectively may further be defined as follows:

y1+y2+y3 has an average value of 2 to 10; and/or z1+z2+z3 has an average value of from 1 to 20.

In further preferred embodiments, independent of each other the x, y and z values may individually or collectively further be defined as follows:

x1+x2+x3 has an average value of 1.8 to 2.2;

y1+y2+y3 has an average value of 6.5 to 7.5; and/or z1+z2+z3 has an average value of from 2 to 12, more preferably 3 to 10.

The average values above are numerical averages, e.g. as derived from the stoichiometry of the alkoxylation reaction by measuring the consumption of the alkylene oxide used.

Alternatively, the glycerin-based polyalkylene glycol can be described by its method of production. The glycerin is subsequently alkoxylated in the following order first with propylene oxide, thereafter ethylene oxide and finally propylene oxide again, wherein the first step is conducted in that 1 to 4, preferably 1.8 to 2.2, equivalents of PO, the second in that 2 to 30, preferably 2 to 10 or more preferred 6.5 to 7.5, equivalents of EO and the third step in that 1 to 25, preferably 2 to 12 or more preferably 3 to 10, equivalents of PO are consumed.

DETAILED DESCRIPTION OF THE INVENTION

The alkoxylation is preferably carried out in the presence of a base catalyst at a temperature from 120° C. to 180° C.

and a pressure of 1 to 10 bar in an agitating or loop reactor. After the reaction of the alkylene oxide with the glycerin starter, an equivalent mole ratio of organic acids can be used to neutralize the base catalyst to an acid value in the range of 0 to 0.3 mg KOH/g. Preferred base catalysts are potassium hydroxide and/or potassium methylate, preferably at a dosage of catalyst in the range of 0.1 to 0.4 wt.-%, relative to the weight of the final end product including the catalyst.

The most preferably organic acids are one or more from glacial acetic acid and lactic acid. The final neutralized salt can be kept in the product or removed by adsorption and filtration technologies well-known by experienced experts in this field.

The glycerin alkoxylate may alternatively be produced by reaction with the alkylene oxide over a suitable alkoxylation catalyst. Suitable catalysts are those derived from the Group IA and Group IIA metals including potassium, sodium, calcium, magnesium; typically, the metal is present as a base salt and notably its hydroxide.

Certain catalyst species are recognized in their ability to produce narrow range alkoxylates having a reduced polydispersity index. A polydispersity index (PDI) of alkoxylated glycerin is defined as the ratio of weight average EO moles to number average. Use of catalyst derived from Group IIA metals, especially calcium or magnesium are typically recognized as being narrow range ethoxylation catalysts. In contrast catalyst derived from Group IA metals, such as potassium hydroxide are generally recognized as giving broad range ethoxylated alcohols where the polydispersity index can be 1.37 or higher.

According to one embodiment, the glycerin alkoxylate is produced by reaction over a narrow range alkoxylation catalyst, more preferably over a calcium-containing ethoxylation catalyst providing an alkoxylated glycerin with a polydispersity index of 1.35 or less, preferably 1.3 or less, more preferably 1.25 or less. Exemplary of a suitable calcium-containing alkoxylation catalysts is the proprietary NOVEL catalyst developed by Sasol (USA) Corporation.

Without being bound to this theory it is assumed that the PO-building blocks directly attached to the glycerin lead to a more balanced distribution of the subsequent EO-addition as they equalize the difference in reactivity between the —OH respectively the EO of the primary and secondary alcohol groups of the glycerin.

The water-soluble polyalkylene glycol of formula (I), has independent of each other one or more of the following properties:

- a pour point according to GB/T 3535 of below −30° C.;
- a hydroxyl number according to GB/T 7383 of 100 to 300 mg KOH/g, preferably 150 to 270 mg KOH/g;
- a kinematic viscosity at 25° C. according to GB/T 265 of below or equal to 1500 cSt, preferably below 300 cSt;
- a kinematic viscosity at 40° C. according to GB/T 265 of below or equal to 100 cSt;
- a kinematic viscosity at 100° C. according to GB/T 265 of below or equal to 10 cSt;
- a water content equal to or below 0.5 wt.-%; and
- a molecular weight between 600 and 1200 g/mol (number average).

In a preferred embodiment the composition comprises 5 to 30 wt.-% of the water-soluble polyalkylene glycol of formula (I).

The composition may further comprise at least one alkanolamine, preferably 5 to 25 wt.-% of at least one alkanolamine. The alkanolamine is preferably selected from the group of monoethanolamine, triethanolamine and/or monoisopropanolamine.

The composition may further comprise boric acid, triazine tricarboxylic acid and/or phosphoric acid and any salts thereof, for example sodium salts, preferably 0.1 to 10 wt. %.

The composition may further comprise at least one carboxylic acid, according to one embodiment 0.1 to 15 wt. %, preferably 0.5 to 10 wt.-%. According to one embodiment of the invention the composition comprises no carboxylic acid. The carboxylic acid may be a C6 to C14 mono- or dicarboxylic acid such as isononanoic acid, 2-butyloctanoic acid, neodecanoic acid, 1,12-dodecanedioic acid. The acid is usually added in an amount until the solutions clears up and the composition has a pH-value between 7 and 10, preferably between 8 to 10 measured at 25° C.

The composition may also comprise 0.1 to 0.5 wt.-% of aminoacetic acid sodium salts, such as tetra sodium EDTA (ethylenediaminetetraacetic acid) and/or 0.1 to 0.5 wt.-% of at least one biocide, such as BUSAN® 77 (Poly[oxyethylene (dimethyliminio)-ethylene(dimethyliminio)ethylene dichloride]).

The amount of water used is preferably between 30 to 85 wt.-%. According to one embodiment the remainder of the composition is demineralized water.

Further the composition preferably has a pH-value between 7 and 10, preferably 8 and 10, each at 25° C.

Preferably the surface tension of the composition is equal to or below 60 mN/m and/or the contact angle on a metal surface is equal to or below 90°.

The cloud point according to GB/T 5559 of 1 wt.-% of the water-soluble polyalkylene glycol of the formula (I) in the metalworking fluid composition with water is preferably above 80° C.

This high cloud point relates to a low dosage of monoacid (e.g. isononanoic acid) required to solubilize the polyalkylene glycol of formula (I) in water, preferably no carboxylic acid such as nonanoic acid is presence of acid.

Another advantage of the composition according to the invention is that the addition of acids often causes smell and foam, especially during extended use times of the metalworking fluid composition. This can be avoided or at least minimized. It is desirable to waive the use of acids.

The composition may be used as a metalworking fluid, showing reduced foaming, a low surface tension and a low contact angle on metal surfaces.

Further the alkoxylated glycerin of formula (I) reduces the tapping torque and increases the cloud point of the composition. In addition, due to the lower amount of carboxylic acid used, the smell of the composition is more pleasant.

More preferably the polyalkylene glycol is used to reduce the surface tension of the compositions to 60 mN/m and below and/or the contact angle on a metal surface to 90° and below.

The water-soluble PAGs of the invention can be used as a fully-synthetic base oils in metalworking fluid compositions. Next to the PAGs and water the composition when used as a metalworking fluid may comprise the above_mentioned acids, amines and other additives.

The metalworking fluids of the present invention are for example used for processes with high shear rates, such as cutting, grinding and punching of metal pieces. This also includes for example the cutting of silicon wafers.

A further use is as a quenching fluid in metalworking. In the above context quenching is the rapid cooling of a workpiece in an oil composition comprising as base oil the PAGs according to the invention.

The use of the compositions as metalworking fluids and the use of the polyalkylene glycols of formula (I) in metalworking fluids and or metalworking processes is also claimed.

Typical metal alloys used in metalworking processes applying the metalworking fluid according to the invention are aluminum alloys of the type 7075, 6061, 5053 and LY 12, red copper, cast iron and iron alloys such as stainless steel.

Measurement Techniques

Pour points are determined according to GB/T 3535 (Chinese equivalent to ASTM D 97), the kinematic viscosity at different temperatures (e.g. at 25, 40 and 100° C.) according to GB/T 265 (equivalent to ISO 3104), the cloud point of 1 wt.-% solution in water according to GB/T 5559 (equivalent to ISO 1065) and the hydroxyl number (mg KOH/g) according to GB/T 7383 (equivalent to ISO 4326).

The further characteristics of a metalworking fluid such as foaming properties, surface tension, contact angle on metal surfaces, sedimentation and lubricity are be measured according to the following methods.

The foaming behavior can be tested by putting 50 ml of a diluted metalworking fluid (usually to 3 to 5 wt.-%) in a 100 ml-measuring cylinder, shaking the cylinder for 1 minute with one hand 100 to 110 times and thereafter and determining the volume of the formed foam in ml as well as the time required until the foam completely decayed again.

Foam is undesirable in metal processing as it impacts the visibility and extends the volume of the liquid. Therefore, the foam formation (measured as provided above) should be below or equal to 20 ml and the foam decay equal to or below 10 seconds.

A broadly recognized method to determine the foaming is the CNOMO foam test D 65 5212, in which the diluted metalworking fluid to be examined is introduced up to the 1000 ml mark in a 2000 ml graduated cylinder, circulated at 250 l/h±10 l/h for 5 hours±5 minutes, while the temperature of the liquid is kept at 23° C.±2° C. using the water circulation. Afterwards the volume of foam formed (in ml) both during the test and the foam remaining after 15 minutes at rest are determined as well as the appearance grading of the liquid (0=no variation to 5=general soiling of the installation) and the flow at the end of the test (in l/h).

The grading is reported in the following way: Time/foam volume/foam volume after 15 min/appearance of the liquid/flow at the end of the test. For example, the grading 300/500/0/0/250 means 500 ml foam volume after 5 hours (300 min) test, no foam after 15 minutes after the end of the test, the initial appearance is not modified and the flow at the end of the test was 250 l/h.

The surface tension of the diluted metalworking fluid can be determined according to ASTM D 3825.

The contact angle on a metal surface such as cast iron can be determined according to ASTM D 5725. The surface tension is preferably below 60 mN/m and the contact angle on cast iron below 90°.

Wear from the metal processing should separate from the metalworking fluid as quick as possible, so that the abrasive wear can be removed effectively from the metalworking fluid so that the metalworking fluid can be recirculated for further use. A method to test this property of used metalworking fluid is to add 5 wt.-% carbon powder to a defined volume of the metalworking fluid or a diluted metalworking fluid, stir the mixture for 5 minutes and observe the sedimentation of the carbon powder at the bottom of a measuring cylinder over time (e.g. after 60 minutes).

The smaller the volume of the phase of the diluted fluid composition mixed with the carbon powder, the better the sedimentation and the more effective the separation. An effective separation allows a more effective recycling of the water in the metal processing.

The lubricity of the diluted metalworking fluid can be determined with or based on the so-called Tapping Torque Test according to ASTM D 5619 (Comparing Metal Removal Fluids Using the Tapping Torque Test Machine). The torque required to tap a thread in a blank specimen nut while lubricated with an oil composition is measured and compared with the torque required to tap a thread in a blank specimen nut while lubricated with a reference fluid. The ratio of the average torque values of the reference oil to the oil composition tested, when using the same tap, is expressed as the percent efficiency of the fluid. One can also compare the mean value of the maximum torque.

The lower the torque, the higher the efficiency of the fluid. For the reported torque values, the used metal alloy, test speed and fluid concentration need to be disclosed.

EXAMPLES

Different polyalkylene glycols based on glycerin as alcohol were produced (see table 1) and compared to commercially available block ethylene oxide-propylene oxide copolymers from BASF (SYNATIVE® RPE 1720 and 1740, see table 2).

The alkoxylation of the glycerin was conducted with KOH as catalyst and if applicable the propoxylation and ethoxylation were done subsequently, so that defined building blocks were attached to the triole. The propylene- and ethylene oxide were consecutively dosed in the according equivalents (e.g. 2 mol eq. for 2 mol PO, 5 mol eq. for 5 EO), but the reaction does of course take place in a statistically manner, which means that in reality the molecules have a statistically distributed degree of alkoxylation for each of the building blocks. That is why the final number of building blocks given for the different products can only be an average over all molecules produced.

TABLE 1

Synthesised glycerin-based polyalkylene glycols

| Compound | Structure | Molecular weight [g/mol] |
|---|---|---|
| 1 Comp. | Glycerin + 7.5 EO | 420 |
| 2 Comp. | Glycerin + 7 EO + 10 PO | 980 |
| 3 Comp. | Glycerin + 18 EO + 37 PO | 3000 |
| 4 Comp. | Glycerin + 10 PO | 671 |
| 5 Comp. | Glycerin + 2 PO + 7 EO | 520 |
| 6 Inv. | Glycerin + 2 PO + 7 EO + 3 PO | 690 |
| 7 Inv. | Glycerin + 2 PO + 7 EO + 7 PO | 920 |
| 8 Inv. | Glycerin + 2 PO + 7 EO + 10 PO | 1100 |
| 9 Comp. | Glycerin + 5 PO + 7 EO + 7 PO | 1100 |

TABLE 2

Properties of commercial and synthesised polyalkylene glycols

| Compound | Water content | Hydroxyl number [mg KOH/g] | Pour point [° C.] | Cloud point [° C.] | Viscosity @25° C. [cSt] | Viscosity @40° C. [cSt] | Viscosity @100° [cSt] |
|---|---|---|---|---|---|---|---|
| RPE 1740 | <0.5% | 42 | 9 | 48.6 | 600 | 300 | 50 |
| RPE 1720 | <0.5% | 39 | −32 | 38.1 | 450 | 230 | 45 |
| 1 | <0.5% | 400-420 | <−10 | >95 | 210 | 100 | 10 |
| 2 | <0.5% | 170-200 | <−30 | >90 | 230 | 105 | 11 |
| 3 | <0.3% | 56-75 | <−30 | 43.9 | 390 | 180 | 30 |
| 4 | <0.5% | 250-270 | <−10 | >95 | 250 | 100 | 10 |
| 5 | <0.5% | 280-300 | <−30 | >90 | 220 | 105 | 10 |
| 6 inv. | <0.5% | 240-270 | <−30 | >90 | 220 | 100 | 10 |
| 7 inv. | <0.5% | 180-210 | <−30 | 82.0 | 225 | 80 | 10 |
| 8 inv. | <0.5% | 150-170 | <−30 | 80.0 | 230 | 80 | 10 |
| 9 | <0.5% | 150-170 | <−30 | 80.0 | 230 | 80 | 10 |

The polyalkylene glycols of table 2 were used in the metalworking fluid composition according to the below formulation (all in wt.-%).

| | |
|---|---|
| Tetra sodium EDTA | 0.30% |
| Monoethanolamine | 5% |
| Triethanolamine | 15% |
| Boric acid | 5% |
| 1,12-Dodecanedioic acid | 2% |
| COMPOUND 1 to 9 or RPE 1740/1720 | 10% |
| IRGACOR ® L 190 Plus (Corrosion inhibitor) | 5% |
| Busan 77 (Biocide) | 0.30% |
| Isononanoic acid | to clear |
| Demineralized water | ~100 |

| Compound | Amount of isononanoic acid |
|---|---|
| RPE 1740 | 5.7 wt.-% |
| RPE1720 | 9.5 wt.-% |
| 1 | 0 wt.-% |
| 2 | 1.5 wt.-% |
| 3 | 9.2 wt.-% |
| 4 | 3.6 wt.-% |
| 5 | 0 wt.-% |
| 6 inv. | 0 wt.-% |
| 7 inv. | 0 wt.-% |
| 8 inv. | 2.8 wt.-% |
| 9 | 2.2 wt.-% |

The compositions according to the invention required significantly less or no addition of isononanoic acid, which not only reduces the formation of foam, but also the formation of smell, especially during the processing of the metalworking fluid.

The metalworking fluids were diluted to 3 wt.-% in distilled water, with a content of Calcium and Magnesium of 100 ppm and the properties of these formulations were determined (see table 3) according to the measurement techniques described above.

The foam creation grading according to CNOMO was the same in all cases, except the volume of foam directly after the 5 hours of the test. Therefore, only this value (X) was reported in table 3. The other values were 300/X/0/0/125.

It can be clearly seen that the metalworking fluids according to the invention made with the glycerin-based polyalkylene glycols 6, 7 and 8 showed a much lower foam formation, a quicker foam decay, a lower tapping torque, a comparable surface tension and contact angle and a lower sedimentation volume compared with commercial EO/PO-block copolymers (1740, 1720), glycerin-EO (1), glycerin-EO-PO (2, 3), glycerin-PO (4), glycerin PO-EO (5) and glycerin PO-EO-PO outside the claimed range (9). These properties qualify them as highly efficient PAG compositions for metalworking applications.

The composition according to the invention when used as a metal working fluid provides for efficient sedimentation or settling properties and can be easily recycled.

TABLE 3

Properties of metalworking fluid compositions.

| | Foam creation [ml]/ defoaming time [s]* | Foam volume according to CNOMO D 65 5212 [ml] | Surface tension [mN/m] ASTM D 3825 | Contact Angle on cast iron [°] ASTM D 5725 | Tapping Torque [Ncm] ASTM D 5619 | Sedimentation volume [ml]# |
|---|---|---|---|---|---|---|
| 1740 | 25 ml/9 sec | 170 | 43.7 | 75.42 | 184.6 | 76 |
| 1720 | 18 ml/8 sec | 160 | 40.1 | 71.15 | 189.2 | 78 |
| 1 | 20 ml/9 sec | 160 | 67.4 | 92.70 | 197.0 | 42 |
| 2 | 37 ml/12 sec | 180 | 49.0 | 81.21 | 177.7 | 70 |
| 3 | 27 ml/13 sec | 170 | 41.1 | 73.60 | 187.5 | 75 |
| 4 | 36 ml/15 sec | 180 | 48.4 | 76.43 | 191.3 | 74 |
| 5 | 30 ml/170 sec | 180 | 64.1 | 89.71 | 184.9 | 51 |

TABLE 3-continued

Properties of metalworking fluid compositions.

| | Foam creation [ml]/ defoaming time [s]* | Foam volume according to CNOMO D 65 5212 [ml] | Surface tension [mN/m] ASTM D 3825 | Contact Angle on cast iron [°] ASTM D 5725 | Tapping Torque [Ncm] ASTM D 5619 | Sedimentation volume [ml]# |
|---|---|---|---|---|---|---|
| 6 inv. | 6 ml/5 sec | 100 | 59.3 | 85.90 | 178.5 | 70 |
| 7 inv. | 20 ml/7 sec | 160 | 53.8 | 85.63 | 177.7 | 68 |
| 8 inv. | 17 ml/8 sec | 160 | 46.7 | 79.60 | 178.7 | 68 |
| 9 | 22 ml/10 sec | 160 | 49.7 | 86.48 | 191.8 | 66 |

*Tested by shaking 50 ml of the metalworking fluid in a 100 ml cylinder for 1 min and determine the volume of the foam afterwards as well as the time required until the foam completely decayed again
#Sedimentation of 5 wt.-% carbon powder at the bottom of a 100 ml cylinder filled and mixed by stirring with diluted metalworking fluid In addition, the water-soluble polyalkylene glycols as used in the composition according to the invention show high cloud points, which is a property well sought after in the metal working fluid technology area. Such higher cloud points are indicative for an increase in the solubility of the base oils in alkaline metalworking fluid compositions. This allows a significant reduction in the amount of monocarboxylic acid solubilisers, where according to a preferred embodiment of the invention monocarboxylic acids are not at all used in the composition or metal working fluid according to the invention. This does not only reduce the foaming problems in metalworking fluid compositions associated with the monocarboxylic acids, but also reduces the odour problems caused by the monocarboxylic acids, which is particularly important in the practical use of metalworking fluids.

The invention claimed is:

1. A composition comprising water; and at least one water-soluble polyalkylene glycol of the formula (I)

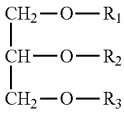

(I)

wherein independently of each other $R_1$ is $—(C_3H_6O)_{x1}—(C_2H_{40})_{y1}—(C_3H_6O)_{z1}—H$;

$R_2$ is $—(C_3H_6O)_{x2}—(C_2H_4O)_{y2}—(C_3H_6O)_{z2}—H$; and $R_3$ is $—(C_3H_6O)_{x3}—(C_2H_{40})_{y3}—(C_3H_6O)_{z3}—H$;

and x1, x2 and x3 are independently of each other a number of 0 to 6;

y1, y2 and y3 are independently of each other a number of 0 to 40; and z1, z2 and z3 are independently of each other a number of 0 to 32;

and x1+x2+x3 has an average value of from 1 to 4;

y1+y2+y3 has an average value of from 2 to 30; and z1+z2+z3 has an average value of from 1 to 25.

2. The composition according to claim 1, wherein independent of each other x1+x2+x3 has an average value of 1.8 to 2.2;

y1+y2+y3 has an average value of 2 to 10; and/or z1+z2+z3 has an average value of from 1 to 20.

3. The composition according to claim 1, comprising 30 to 85 wt.-% water.

4. The composition according to claim 1, comprising 5 to 30 wt.-% of the water-soluble polyalkylene glycol of formula (I).

5. The composition according to claim 1, further comprising at least one alkanolamine.

6. The composition according to claim 1, further comprising 0.1 to 15 wt. % of a carboxylic acid.

7. The composition according to claim 1, wherein the composition comprises no C6 to C16 mono- or di-carboxylic acid.

8. The composition according to claim 1, comprising 0.1 to 0.5 wt.-% of aminoacetic acid sodium salts, and/or 0.1 to 0.5 wt.-% of at least one biocide.

* * * * *